US009758955B1

(12) United States Patent
Lee

(10) Patent No.: US 9,758,955 B1
(45) Date of Patent: Sep. 12, 2017

(54) HUMAN POWERED GREY WATER TOILET RETROFIT SYSTEM AND METHOD

(71) Applicant: Sam Lee, Naperville, IL (US)

(72) Inventor: Sam Lee, Naperville, IL (US)

( * ) Notice: Subject to any disclaimer, the term of this patent is extended or adjusted under 35 U.S.C. 154(b) by 130 days.

(21) Appl. No.: 14/986,652

(22) Filed: Jan. 2, 2016

(51) Int. Cl.
*E03D 5/00* (2006.01)
*E03D 1/33* (2006.01)
*E03D 5/08* (2006.01)

(52) U.S. Cl.
CPC ..... *E03D 5/003* (2013.01); *E03D 1/33* (2013.01); *E03D 5/08* (2013.01)

(58) Field of Classification Search
CPC ..... E03D 5/003; E03D 5/08; E03D 1/33
USPC ..... 4/395; 137/426
See application file for complete search history.

(56) References Cited

U.S. PATENT DOCUMENTS 1,585,557 A 5/1926 Miller
1,864,827 A 6/1932 Jenkins et al.
2,467,019 A 4/1949 Farson
3,594,828 A 7/1971 Seek
3,594,829 A 7/1971 Seek
3,883,904 A 5/1975 Wittman
4,115,879 A 9/1978 Toms
4,162,218 A 7/1979 McCormick
4,197,597 A 4/1980 Toms
4,358,864 A 11/1982 Medrano
5,084,920 A 2/1992 Kimball
5,142,708 A 9/1992 Johnson et al.
5,201,082 A 4/1993 Rockwell
5,317,766 A 6/1994 McDonald et al.
5,345,625 A 9/1994 Diemand
5,398,465 A 3/1995 Tagg
5,452,956 A 9/1995 Gilliam
5,496,468 A 3/1996 Cormier
5,498,330 A 3/1996 Delle Cave
5,573,677 A 11/1996 Dembrosky
5,813,047 A 9/1998 Teichroeb
5,845,346 A 12/1998 Johnson, Jr.
5,937,455 A 8/1999 Donati
6,276,005 B1 8/2001 Sanders et al.
6,328,882 B1 12/2001 Rosenblatt
6,702,942 B1 3/2004 Nield
6,796,250 B1 9/2004 Greene
6,802,090 B2 10/2004 Martin
6,889,395 B1 5/2005 Hodges
6,904,926 B2 6/2005 Aylward et al.
7,121,292 B2 10/2006 Aylward et al.
7,533,688 B2 * 5/2009 Schuster ..... E03D 1/32 137/426
7,913,331 B2 3/2011 Hartman
D649,233 S 11/2011 Du
(Continued)

*Primary Examiner* — Tuan N Nguyen

(57) ABSTRACT

A grey water toilet system utilizing a pedal interface to trigger the toilet flush and to resupply the toilet tank with grey water. The grey water is generally collected from a nearby water fixture such as a wash basin and placed in a storage reservoir until the user flushes the toilet. This invention can be used to retrofit most existing toilets without the need for remodeling thus making it possible to expand the use of grey water for toilets, potentially leading the way for significant fresh water savings. It is estimated that the average American residence uses in the range of 100,000 gallons of water annually and that more water is used to flush toilets than any other individual activity.

19 Claims, 16 Drawing Sheets

(56) References Cited

U.S. PATENT DOCUMENTS

| | | | | |
|---|---|---|---|---|
| 8,286,273 | B1 | 10/2012 | Toomer | |
| 8,696,897 | B2 | 4/2014 | Marugame | |
| 8,931,122 | B1 | 1/2015 | Cerce | |
| 8,974,663 | B2 | 3/2015 | Aylward et al. | |
| 9,057,186 | B1 | 6/2015 | Augustine | |
| 2001/0052147 | A1* | 12/2001 | Lee | E03D 5/08 4/441 |
| 2014/0059755 | A1 | 3/2014 | Garrels et al. | |

* cited by examiner

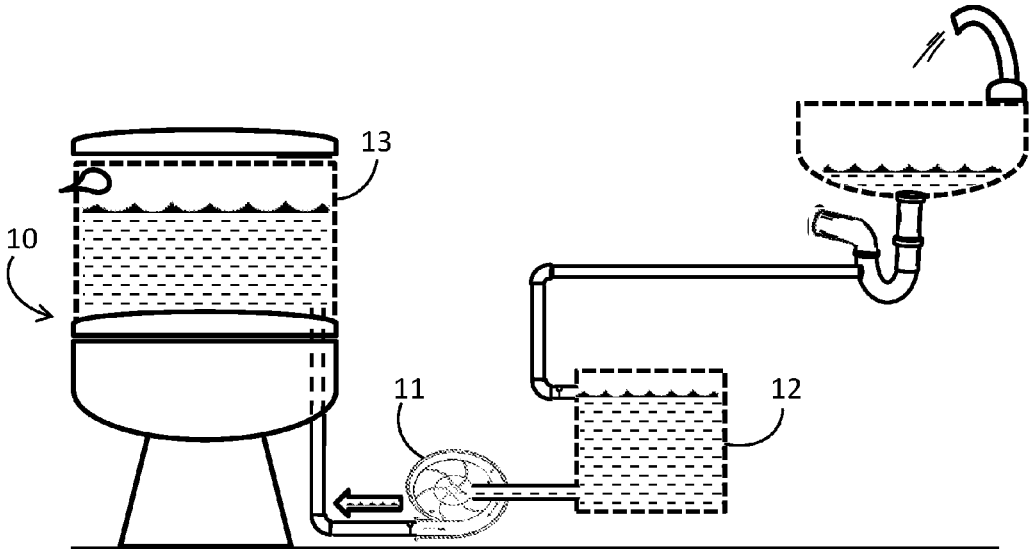
FIG. 1 – Prior Art
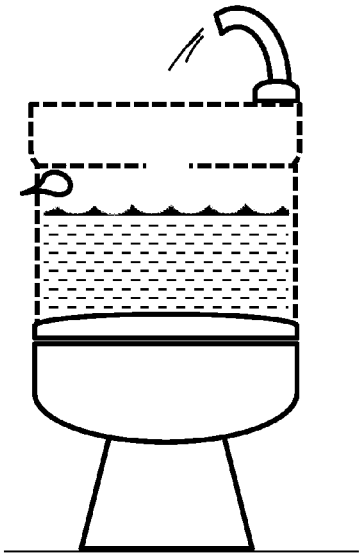
FIG. 2 – Prior Art
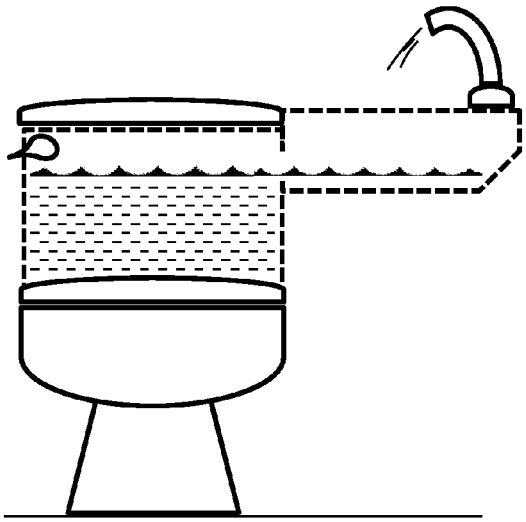
FIG. 3 – Prior Art

HUMAN POWERED GREY WATER TOILET RETROFIT SYSTEM AND METHOD

TECHNICAL FIELD

This invention is in the field of grey water usage for flushing toilets.

BACKGROUND ART

It is estimated that the average American residence uses in the range of 100,000 gallons of water annually and that more water is used to flush toilets than showering or any other individual activity (Reference: Indoor Water Use in the United States, US EPA, June 2008, EPA-832-F-06-004). Grey water is defined as lightly used or unprocessed water which can be re-applied, in this case, to the flushing of toilets. Currently, almost all grey water is disposed of right after leaving the source fixture (e.g. a wash basin) or appliance (e.g. a washing machine). Numerous grey water toilet systems have been proposed in order to conserve water.

One type of system serves an entire building and utilizes a common reservoir where grey water is collected from the sinks, showers, bath tubs, washing machines, rain collection points, appliances etc. The stored grey water is then utilized by grey water applications such as toilets. This type of system requires extensive design and integration and is costly to retrofit into existing buildings. Examples of these systems include U.S. Pat. No. 4,115,879, 1978 Toms; U.S. Pat. No. 4,197,597, 1980 Toms; U.S. Pat. No. 4,162,218, 1979 McCormick; U.S. Pat. No. 5,345,625, 1994 Diemand; U.S. Pat. No. 5,452,956, 1995 Gilliam; U.S. Pat. No. 5,496,468, 1996 Cormier; U.S. Pat. No. 5,498,330, 1996 Delle Cave; U.S. Pat. No. 5,573,677, 1996 Dembrosky; U.S. Pat. No. 5,845,346, 1998 Johnson; U.S. Pat. No. 6,328,882, 2001 Rosenblatt; U.S. Pat. No. 6,702,942, 2004 Nield; U.S. Pat. No. 6,796,250, 2004 Greene; U.S. Pat. No. 6,889,395, 2005 Hodges; 6904926, 2005 Aylward et al.; 7121292, 2006 Aylward et al.; 8974663, 2015 Aylward et al.; 7913331, 2011 Hartman; U.S. Pat. No. 8,696,897, 2014 Marugame; U.S. Pat. No. 5,084,920, 1992 Kimball.

Less expansive grey water toilet systems include connected sink/toilet combinations, FIG. 1 (examples include U.S. Pat. No. 4,358,864, 1982 Medrano; U.S. Pat. No. 6,276,005, 2001 Sanders et al.; 6802090, 2004 Martin; and U.S. Pat. No. 8,931,122, 2015 Cerce) as well as integrated sink/toilet fixtures, FIG. 2, FIG. 3 (examples include U.S. Pat. No. 5,813,047, 1998 Teichroeb and U.S. Pat. No. 9,057,186, 2015 Augustine). However, even these simpler grey water toilet systems require a significant investment to install into existing bathrooms due to the need for remodeling the bathroom area. Often, replacement or repositioning of the existing fixtures is necessary. In addition, some of these systems require electrical access to power the pump 11 used to pressurize or move the grey water from a storage reservoir 12 to the toilet 10 (examples include U.S. Pat. No. 5,201,082, 1993 Rockwell; U.S. Pat. No. 5,317,766, 1994 McDonald et al.; 5937455, 1999 Donati; and U.S. Pat. No. 0,059,755, 2014 Garrels et al.). The various costs associated with the installation of a grey water toilet such as remodeling, outage time, and inconvenience, are deterrents to the adoption of these systems.

Foot operated devices have been applied for different individual toilet functions in the past. Foot pedals have been used to trigger the flush operation of toilets for many years. Examples include U.S. Pat. No. 1,585,557, 1924 Miller; U.S. Pat. No. 1,864,827, 1931 Jenkins et al.; 2467019, 1944 Farson; U.S. Pat. No. 3,594,828, 1971 Seek; U.S. Pat. No. 3,594,829, 1971 Seek; U.S. Pat. No. 3,883,904, 1975 Wittman; U.S. Pat. No. 5,142,708 1992 Johnson et al.; U.S. Pat. No. 8,286,273 B1, 2012 Toomer; and D6492335, 2011 Du, as well as Chinese patents: CN202370063U, 2012 and CN203222872U, 2013. These devices attach to the existing flush mechanisms of toilets and apply a small amount of energy from a user's foot action to trigger a flush event, providing more hygienic touch free flushing. Foot powered pumps have also been proposed to provide flush water for portable toilets. An example is U.S. Pat. No. 5,398,465, 1995 Tagg. Foot powered pumps and water transfer mechanisms for flushing toilets have been proposed by several Chinese patents: CN2166167Y, 1994; CN2355010Y, 1999; CN2407051Y, 2000; CN2496938Y, 2002; CN2639383Y, 2004; CN2742053Y, 2005; and CN103726543A, 2014. However, these foot powered water transfer devices are not designed to integrate with existing toilets and require custom installation or remodeling. Some are standalone components and do not offer a complete solution. For example, many of these designs require installation of a custom toilet versus integrating with an existing toilet. A practical grey water toilet retrofit system should handle all the functions related to flushing a toilet with simple input from the user. These functions include: triggering the flush mechanism, resupplying the toilet tank with grey water and handling situations when there is either too much or too little grey water. The use of grey water in toilets has not been commercially viable or widely available in part due to the high cost to retrofit existing toilets with a practical system. The goal of this invention is to overcome these obstacles.

SUMMARY OF INVENTION

Technical Problem

Toilets commonly employ a cistern, otherwise known as a toilet tank 20, to hold a volume of water which is released during a flush cycle. The toilet tank is typically filled from the building's fresh water supply plumbing. This invention proposes a method, FIG. 6, along with a system, FIG. 4, to retrofit existing toilets to utilize grey water instead of fresh water. It aims to provide a user installable, ergonomic system, through a combination of new and prior art to: collect grey water from existing bathroom fixtures; store a supply of grey water until needed; trigger the toilet's native flush mechanism; move the grey water to the toilet tank at the appropriate point in time; and resolve situations when grey water is either lacking or overabundant.

Typical residential bathrooms have a toilet with a wash basin nearby. However, most existing wash basins are positioned too low to allow the resultant grey water to flow directly into most existing toilet tanks. Thus, current grey water toilet systems either require the wash basin drain to be raised higher than the toilet tank level or require a powered pump 11 to move the grey water from a storage reservoir 12 up to the level of the toilet tank 13. Many of these systems necessitate remodeling to position the fixtures appropriately or to provide an electrical source for the required pumping mechanism.

Typically, toilet tanks 60 are at a level of approximately 0.305 to 0.610 meters (1 to 2 feet) above the bathroom floor. Thus the grey water held in the temporary storage reservoir 61, positioned near the bathroom floor level, FIG. 8, must be moved up in elevation to fill a toilet tank. For example, many current toilets in the United States utilize 6.06 liters (1.60 gallons) per flush. Therefore an embodiment of a grey water toilet retrofit system must be capable of lifting at least 6.06 liters up in elevation of approximately 0.610 meter (2 feet).

The energy $E_w$ required to lift grey water of weight w an elevation rise d is represented in FIG. 9 and shown by the equation EQ1:

$$E_w = w \times d \quad \text{EQ1:}$$

To supply the same amount of energy, $E_f$, with a foot pedal, a force F on the pedal for a travel distance h is required. This is represented in FIG. 7 and shown by the equation EQ2:

$$E_f = F \times h \quad \text{EQ2:}$$

Combining these two equations result in the unified equation EQ identifying the force F required on the foot pedal to move the grey water from the reservoir to the toilet tank under ideal conditions:

$$F = (w \times d)/h \quad \text{EQ:}$$

Ergonomically it would be beneficial to minimize both the required pedal force F, FIG. 7 as well as pedal travel distance h, FIG. 7. From EQ, we see that decreasing the required elevation raise d, FIG. 9 as well as decreasing the volume of grey water w, FIG. 9 support these goals.

For example, since the weight of 6.06 L (1.60 gallons) of water is 6.06 kg, a force of 59.3 N is required to lift this weight. From EQ1, the energy required to move 6.06 L of grey water up 0.610 m is 36.2 Joules (59.3 N×0.610 m). From EQ2, this is equivalent to pressing down on a pedal with a force of 36.2 N for 1 m or equivalently 119 N for 0.305 m. If however, the grey water held in the reservoir can be positioned above the floor level, less pedal force will be necessary. For example, if it is possible to install the grey water reservoir elevated to 0.305 m (1 ft) above floor level, then only 18.1 J of energy or 59.3 N of force for 0.305 m is needed to lift the grey water up to the toilet tank. This is half of the energy and force on the pedal needed to move the grey water up to the toilet tank as compared to the 0.610 m elevation rise scenario. Thus it is beneficial to mount the reservoir as high as possible but still low enough to collect grey water from the various sources.

Although a small amount of additional force is necessary to overcome parasitic losses and to trigger the toilet flush mechanism, we see from these examples that a force of approximately 59.3 N to 119 N (13.3 to 26.7 pound-force) and a pedal movement of 0.305 m (1 ft) is sufficient to move the amount of grey water needed for a single flush in a typical contemporary toilet in the US today. Since there is a wide variation of toilet tank and wash basin design, the necessary elevation rise and thus pedal force required will vary with each setup. In addition, many older toilets require more water to flush and thus a greater grey water capacity from embodiments of this invention.

From this discussion, we see that it is possible for the average person to impart enough energy with a single foot pedal actuation to lift the necessary amount of liquid to resupply a toilet tank.

System timing, FIG. 5, is another factor in creating a practical human powered grey water retrofit system. Two areas related to timing need to be considered: timing when the foot pedal can be released after the actuation stroke; and timing when the main volume of the grey water is transferred into the toilet tank relative to the flush cycle, which varies based on the specific toilet system design.

Ergonomically, it is preferable that the user does not have to worry about timing at all. Thus the foot pedal should be allowed to be released at any time after the actuation stroke so that the user does not have to hold the pedal down waiting for the flush cycle to complete or progress to a certain point.

Timing when the main volume of grey water is sent to the toilet tank varies with the many toilet designs and flush cycles being used. Ideally, the main volume of grey water should be introduced into the toilet tank when the current flush cycle progresses to the point where the grey water is able to supply the toilet tank for the next flush cycle. Introducing grey water too early can result in the grey water flowing out prematurely with the current flush cycle. In some installations, the inherent delay in moving the grey water into the toilet tank provides sufficient time to prevent this. In other installations, an additional explicit delay is also needed.

Other considerations include: how to handle situations when either too much or too little grey water is available as well as how to trigger the toilet's flush mechanism as an integral part of an embodiment.

A solution to these problems without the need for significant remodeling or the need for electrical power will help grey water usage for flushing toilets become more broadly accepted thereby achieving greater water conservation.

Solution to Problem

As demonstrated by one or more of the embodiments described here, this invention relates to methods and devices that utilize grey water for the flushing of toilets. Grey water 24 is collected 50 in a holding reservoir 25 in advance of a flush operation. A pedal 21 mechanism begins receiving energy 51 from the user. This energy is stored 52 by an energy storage mechanism 26 as it is received. A toilet flush is triggered 53 directly when the pedal is actuated 57 or indirectly through the energy storage mechanism 26 after sufficient energy is available 56. Receiving energy from the pedal 51, triggering the toilet flush 53 and storing the pedal energy 52 can overlap in time and occur simultaneously. A delay 55, comprising intrinsic and optionally explicit portions, defers the grey water introduction into the toilet tank. The explicit delay component 28 allows the current flush to progress before the transfer mechanism 27 moves 54 the grey water 24 from a holding reservoir 25 into the toilet tank 20. The grey water from the holding reservoir 25 can also supplement the current flush cycle as well as supply the toilet tank 20 for the next flush cycle.

The amount of energy required to move the grey water depends on both the amount of grey water required and the elevation rise d, FIG. 9 from the holding reservoir to a toilet tank. For example, from equation EQ, we see that 36.2 Joules of energy is required to move 6.06 liters (1.6 gallons) of grey water up an elevation of 0.610 meter (2 feet). A pedal operated mechanism will be able to provide this energy by applying 119 N (26.7 lb.-force) over a pedal travel distance of 0.305 m (1 ft.).

Triggering the flush cycle for typical toilets require minimal pressure on the toilet's flush mechanism. For example, 8.90 to 22.2 N (2 to 5 lbs. of force) over 2.54 to 5.08 cm (1 to 2 inches) or in the range of 1 Joule of energy will normally be sufficient to trigger a mechanical toilet flush.

Typical embodiments of this system comprise: a reservoir 25 for collecting grey water 24 in advance of a toilet flush; a pedal 21 for receiving human mechanical energy from a user's foot 23 actuation; an energy storage mechanism 26, for example, such as a spring or weight or pneumatics to hold the imparted human energy allowing the pedal to be released immediately after the foot actuation; a flush trigger actuator link 22 and flush adaptor 32 to trigger the toilet's native flush mechanism 31; a manual powered liquid transfer mechanism 27 or pump to transfer the grey water 24 to the toilet tank 20; and a grey water outlet 29 connecting the reservoir with the toilet tank. An explicit delay mechanism 28 can be included to control the point in time when the grey water enters the toilet tank if needed for a particular installation.

The liquid storage reservoir 25 stores the grey water 24 which can originate from various sources. Ideally, this reservoir is positioned lower than the grey water source 30 so that grey water can naturally flow into it utilizing gravity, without the need for mechanical assistance. Typically, this grey water storage reservoir 25 is positioned near floor level, below the exit pipes of nearby fixtures which supply the grey water but as high as possible to minimize the energy required to move the stored grey water to the toilet tank.

The pedal 21 operated mechanism is utilized by the user to start a flush cycle. When pressure is applied by the user's foot 23, a mechanical link 22 actuates the flush adaptor 32 connected to the toilet's flush mechanism 31 initiating a normal flush cycle. Continued foot pressure provides energy to transfer the grey water in the holding reservoir 25 up to the toilet tank 20 resupplying the toilet tank in preparation for the next flush cycle. While it is desirable to utilize a single pedal stroke per flush cycle, multiple strokes may be applied to decrease pedal effort or shorten stroke distance or provide additional energy which can be stored for future flush cycles.

The energy storage mechanism 26 holds the energy from the user's pedal actuation, thus allowing the pedal to be released immediately. This energy storage mechanism can utilize an explicit component, such as for example a spring, or alternatively can be realized without an explicit component, for example by imparting potential energy to the grey water by elevating it. For single pedal stroke operation, the energy storage capacity should hold enough energy to operate a single flush cycle. However, larger energy storage capacities can also be utilized to store energy for additional flush cycles.

Since the time it takes to complete a flush cycle varies with different toilets, it is beneficial in some installations to delay the transfer of grey water into the toilet tank so that it does not all flow out to the toilet bowl during the current flush cycle. This can occur if the grey water is introduced into the toilet tank too early during the flush cycle.

Timing diagram FIG. 5 shows the flush and fill cycles of a retrofitted grey water toilet as reference. Small parasitic delays in timing are not represented. The exact timing varies based on different toilet designs and installations. The flush cycle begins when a user depresses the foot pedal at time 40 and triggers the toilet's native flush mechanism. At this point, the flush valve is opened and the previously stored water in the toilet tank begins to flow into the toilet bowl. At the same time, energy from the pedal actuation is stored, allowing the flushing process to continue even as the pedal is released at time 41. The grey water fill process is delayed for time interval 45 until the current flush cycle progresses to time 42, the point at which the grey water is able to supply the toilet tank for the next flush cycle, preventing all of the grey water from flowing out prematurely with the current flush cycle. The delay duration 45 is comprised of an implicit system delay due to the grey water flow rate and grey water distance traveled from the reservoir to toilet tank as well as an optional explicit delay needed for some toilet setups. This optional explicit delay may not be needed in cases where the implicit delay is sufficient. For example, this may be the case for toilets with high flush flow rates where a large flush valve closes quickly after a flush cycle is triggered.

If needed, the explicit delay duration can be determined through monitoring one of the toilet's operating parameters such as the liquid level in the toilet tank, pressure level in the toilet tank, flow rate out of the toilet tank and flush valve position. Alternatively, a fixed timer based on timing from prior flush cycles, can also be applied. FIG. 18 through FIG. 20 are examples of valves that can be utilized to provide the appropriate explicit delay by sensing the surrounding liquid level in the toilet tank and allowing the grey water to enter when the level reaches a predetermined point.

The toilet tank's flush valve begins to close near time 42. This point is near the end of the flushing process at time 43 when the water level in the toilet tank is at or near its low water mark. The toilet tank's native fill system is left intact ensuring that enough water is provided to the toilet tank for the next flush cycle in case there is insufficient grey water available. This native fill system introduces fresh water at a relatively slow rate as compared to the flushing rate of water exiting to the toilet during the flush interval, see FIG. 5, and continues to fill the toilet tank with fresh water from the beginning of the flushing interval at time 40 to the end of the fill process at time 44. To maximize the fresh water savings, embodiments can introduce grey water at a sufficiently high rate to fill the toilet tank, before significant fresh water is introduced by the native fill system.

Additional fresh water savings can be achieved by modifying the native fresh water fill system to include a delay or by decreasing the fresh water input flow rate. This allows more grey water to fill the toilet tank and thus requiring less fresh water. Partially closing the fresh water supply valve 33 into the toilet tank is one way to achieve a fresh water flow rate reduction. Any excessive grey water introduced to the toilet tank is automatically expelled by the toilet tank's native overflow system.

Advantageous Effects of Invention

This human powered system allows more efficient usage of water resources by enabling existing bathrooms to be retrofitted to use grey water for the flushing of toilets. Existing wash basins and toilets can be integrated with this grey water flush system with minimal or no remodeling and without the need to add an electrical source to power the system.

A pedal 21 interface makes this system ergonomically easy to use and accessible to most users. This pedal performs key functions including triggering the toilet's flush mechanism 31 and providing energy to supply the toilet tank 20 with grey water 24 for the next flush.

Automated functions provide consistent operation allowing the user to release the pedal 21 at any time without concern about the system timing or grey water availability. An energy storage mechanism 26 holds the energy received from the pedal 21 allowing the pedal 21 to be released immediately after actuation. If needed, an optional explicit delay 28 of the grey water to the toilet tank allows enough time for the flush cycle to progress, preventing most of the grey water from flowing out to the toilet bowl with the current flush cycle.

The toilet's existing fresh water fill mechanism is utilized to supplement the grey water should the supply of grey water be temporarily unavailable or inadequate. For example, this may happen if multiple flushes are performed before sufficient grey water is collected in the liquid storage reservoir.

Excessive grey water is expelled, utilizing the toilet tank's existing overflow mechanism should too much grey water be introduced into the toilet tank, preventing an overflow situation. These features combine to provide ease of use as well as backup redundancy. If this grey water retrofit system fails, the toilet can continue to operate as it would before the retrofit by utilizing its native flush and fresh water fill capabilities.

Although, this system is focused towards retrofitting existing toilet installations, it can also be applied to new toilet installations.

BRIEF DESCRIPTION OF DRAWINGS

FIG. 1 Grey water toilet system utilizing electric pump—Prior Art

FIG. 2 Grey water toilet system with wash basin as toilet tank cover—Prior Art FIG. 3 Grey water toilet system with unified wash basin and toilet tank—Prior Art FIG. 4 Human powered grey water toilet retrofit system, concept view FIG. 5 Timing diagram, retrofitted grey water toilet flush and fill system FIG. 6 Flow chart, retrofitted grey water toilet flush and fill system FIG. 7 Energy $E_f$ from foot pedal as a function of force and stroke distance FIG. 8 Reservoir collecting grey water from wash basin prior to flush FIG. 9 Energy $E_w$ needed to transfer grey water from reservoir to toilet tank FIG. 10 Human powered grey water toilet retrofit system, example 1 embodiment FIG. 11A Pressure based transfer and energy storage mechanism in trigger/transfer phase, embodiment FIG. 11B Pressure based transfer and energy storage mechanism in refill phase, embodiment FIG. 11C Pressure based transfer and energy storage mechanism in ready phase, embodiment FIG. 12A Elevation based transfer and energy storage mechanism in trigger/transfer phase, embodiment FIG. 12B Elevation based transfer and energy storage mechanism in refill phase, embodiment FIG. 12C Elevation based transfer and energy storage mechanism in ready phase, embodiment FIG. 13 Handle pull flush trigger adapter, conceptualized drawing FIG. 14 Button press flush trigger adapter, conceptualized drawing FIG. 15 Internal actuated flush trigger adapter, conceptualized drawing FIG. 16 Grey water extraction adapter embodiment FIG. 17A-D Toilet tank fill adapter embodiment, without valve FIG. 18A Liquid level sensing valve embodiment, closed position FIG. 18B Liquid level sensing valve embodiment, closed position, cutout view FIG. 18C Liquid level sensing valve embodiment, open position FIG. 18D Liquid level sensing valve embodiment, open position, cutout view FIG. 19A-D Toilet tank fill adapter with liquid level sensing valve, embodiment FIG. 20A Liquid level sensing valve horizontal embodiment, closed position FIG. 20B Liquid level sensing valve horizontal embodiment, open position FIG. 20C Liquid level sensing valve horizontal embodiment, exploded view FIG. 21 Grey water toilet tank fill adapter, cover entry embodiment FIG. 22 Grey water toilet tank fill adapter with level sensing valve, cover entry embodiment FIG. 23 Grey water toilet tank fill adapter, tank entry embodiment FIG. 24 Grey water toilet tank fill adapter with level sensing valve, tank entry embodiment

DESCRIPTION OF EMBODIMENTS

Figure 4:
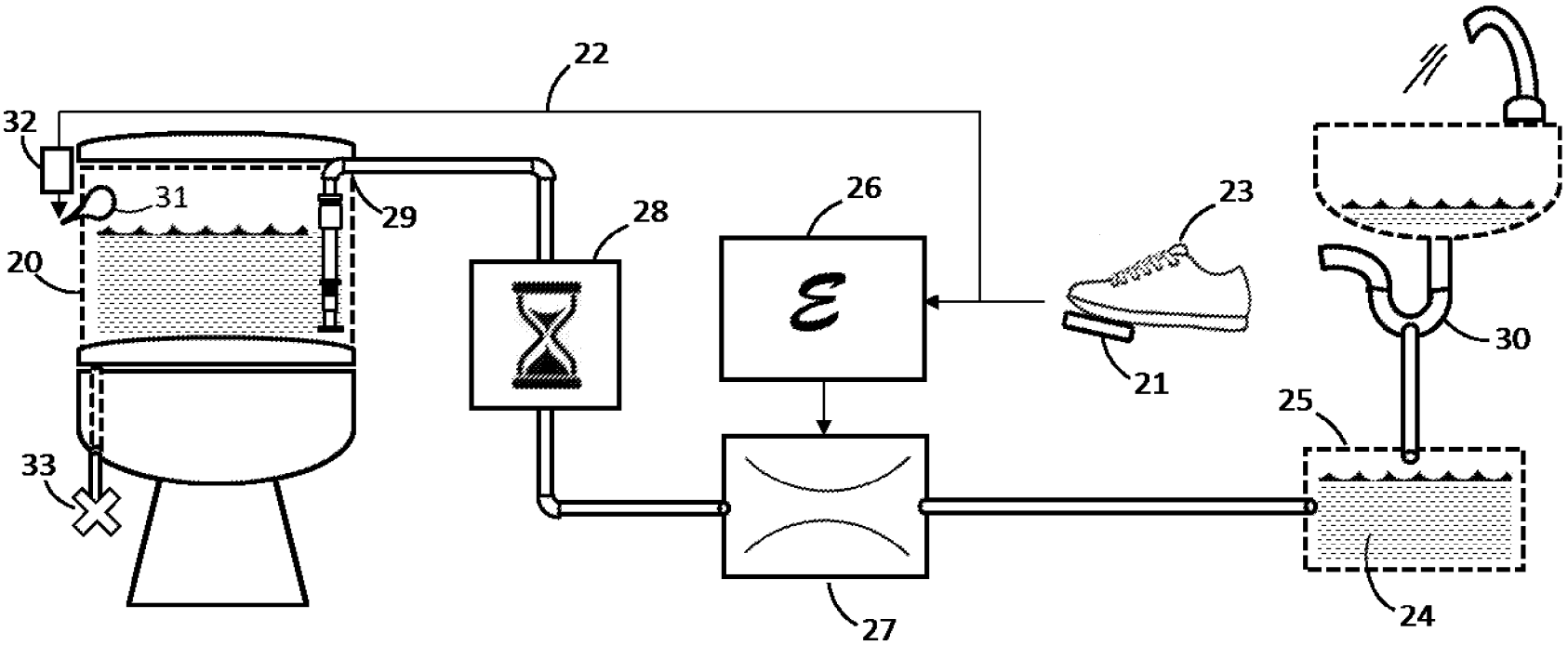
Figure 5:
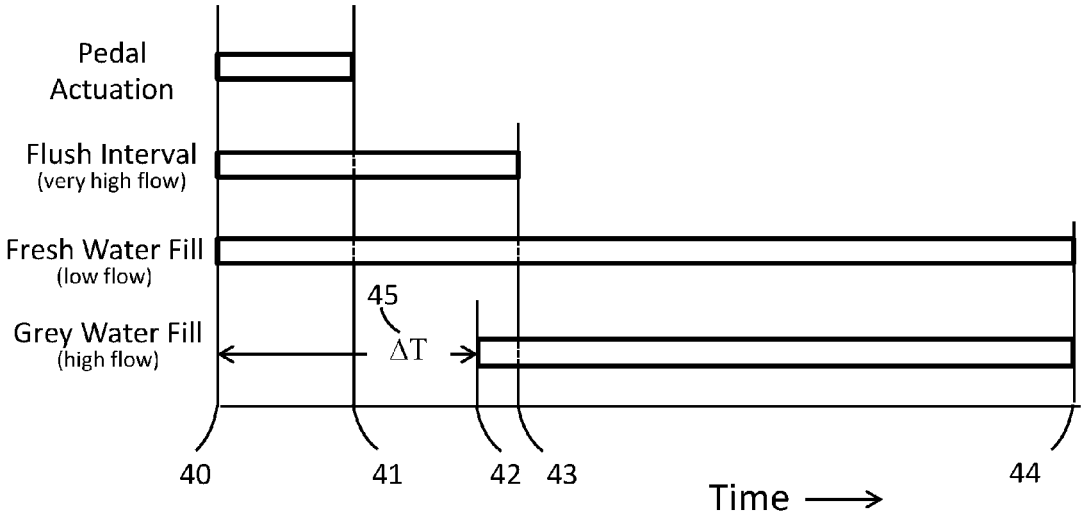
Figure 6:
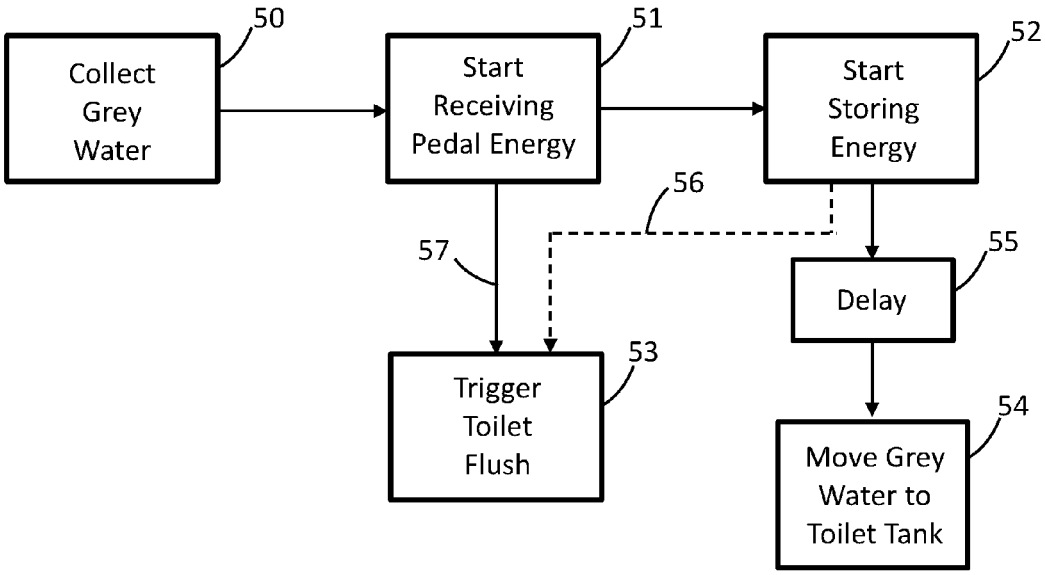
Figure 7:
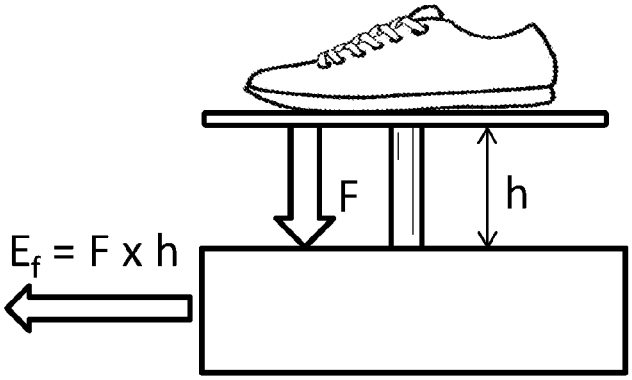
Figure 8:
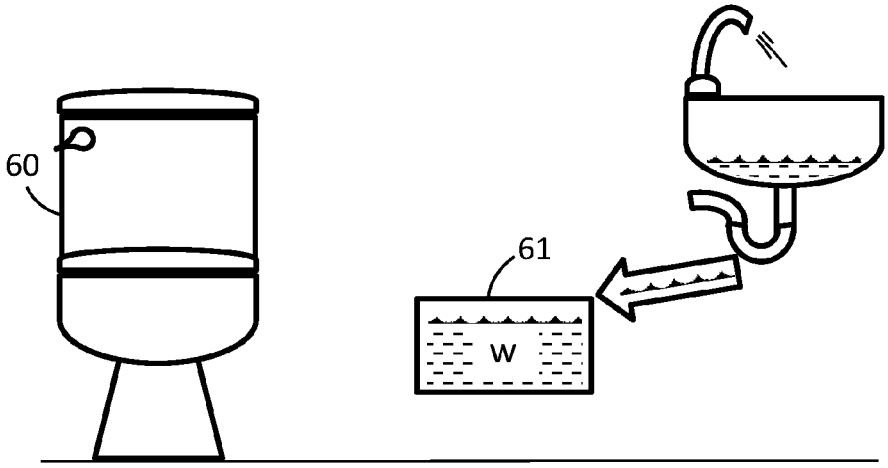
Figure 9:
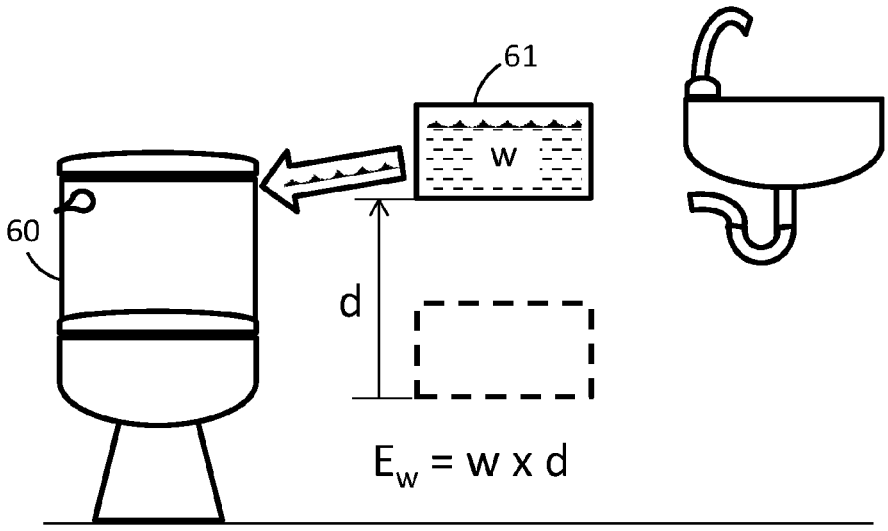
Figure 10:
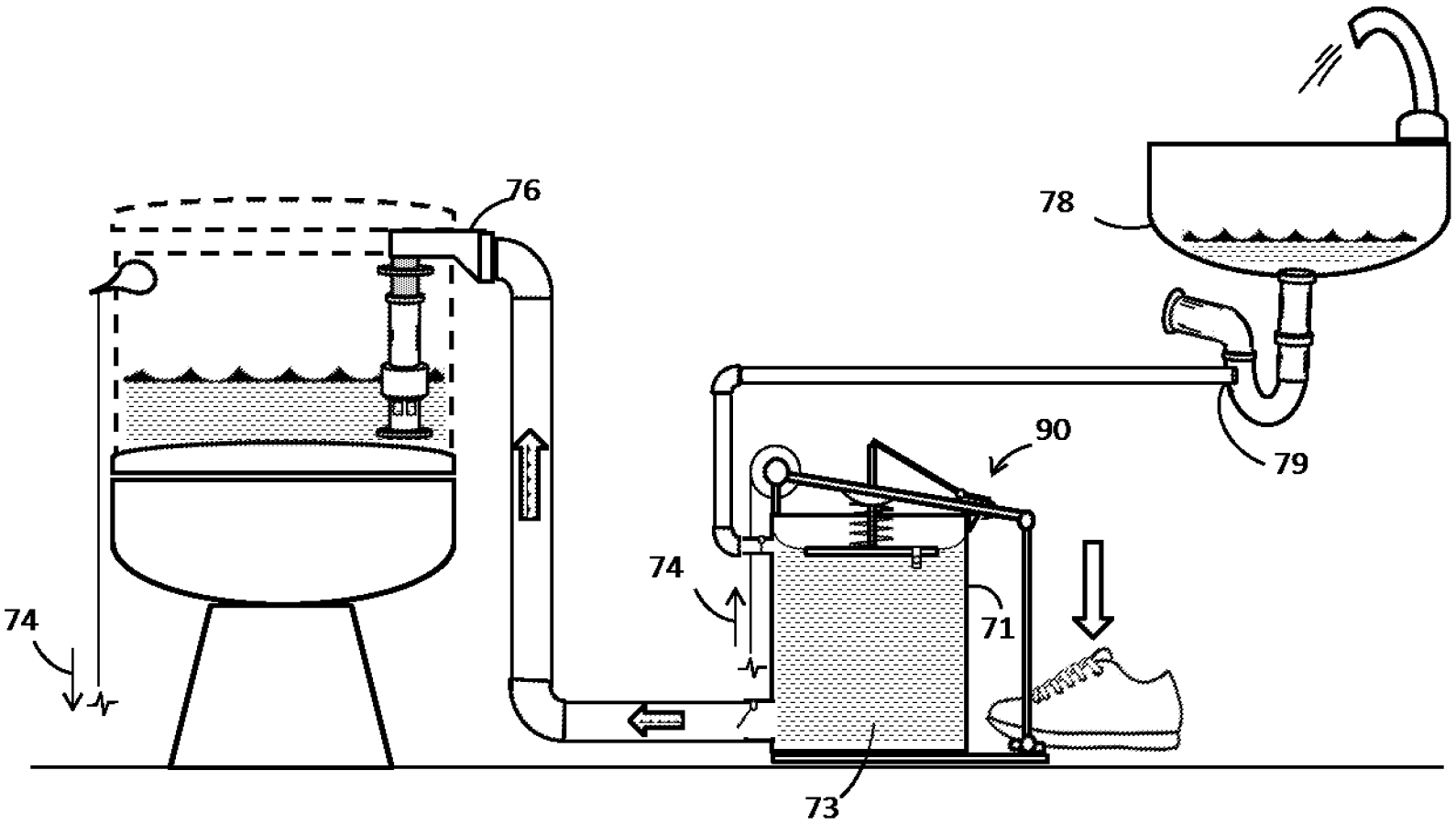

As demonstrated by one or more of the embodiments, this invention relates to devices that utilize grey water for the flushing toilets. Central to the invention is the method and system to utilize human power to trigger a toilet flush cycle and re-supply the toilet tank with grey water for the next flush cycle.

In this respect, before explaining at least one embodiment of the invention in detail, it is to be understood that the invention comprises of a combination of pre-existing as well as new components and is not limited in its application to the details of construction and to the arrangements of the devices and components set forth in the following description or illustrated in the drawings. The invention is capable of other embodiments and of being practiced and carried out in various ways. Also, it is to be understood that the phraseology and terminology employed herein are for the purpose of the description and should not be regarded as limiting. There are many alternate forms of the described embodiments. Any suitable device, component, size, shape, position or type of materials can be used to implement this invention.

The following are example embodiments covering the different components making up this system, see FIG. 4. The functions performed by this system may be combined and embodied in numerous ways. Modules can perform individual functions or, alternatively, multiple functions can be implemented together in the same module as in the following examples.

Example 1: Pressure Based Grey Water Toilet Retrofit System and Method

Figure 11A:
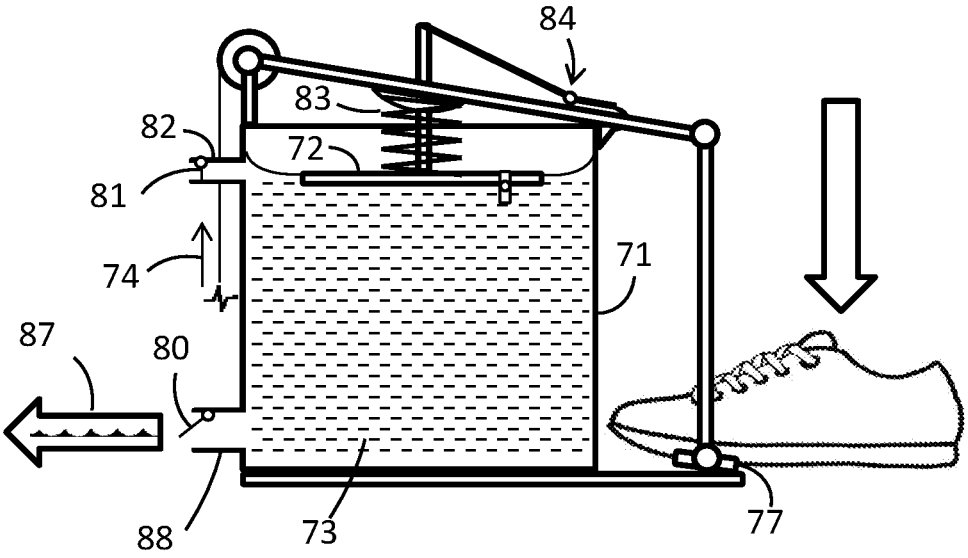
Figure 11B:
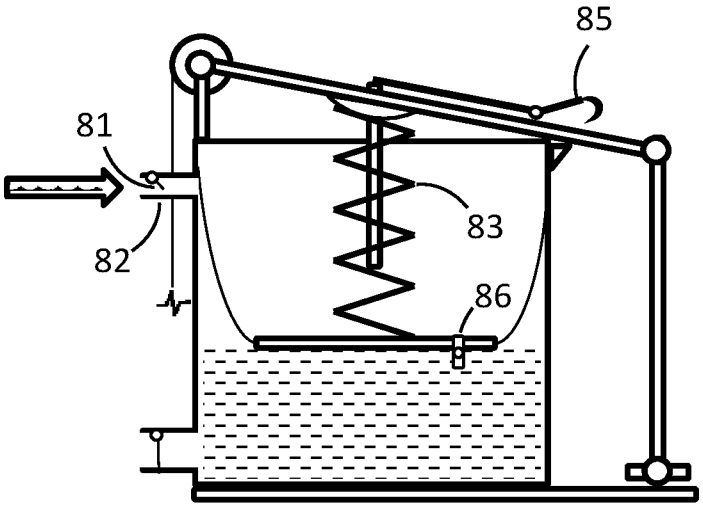

This embodiment applies pressure directly to the grey water in order to force it out of the reservoir and into a toilet tank. In this example, the reservoir 71, pedal 77, energy storage 83, flush actuator link 74 and pump/liquid transfer mechanisms 90 are unified, decreasing the overall footprint of the system. While numerous mechanisms can be devised to pressurize the grey water, FIGS. 10, 11A, 11B and 11C are depictions of one embodiment based on a pedal operated mechanism during the three phases of operation: FIG. 11A, trigger/transfer; FIG. 11B, refill; and FIG. 11C, ready. This embodiment utilizes a direct pressure design applying principles of a hybrid diaphragm/displacement pump. This pump/liquid transfer mechanism is integrated with the grey water reservoir 71. The top of the reservoir incorporates a diaphragmed plunger 72 in contact with the grey water 73. Note that any alternate pump design, such as for example a piston and cylinder (not shown), which can move approximately 6.06 liters (1.6 gallons) of water up an elevation of approximately 0.610 meters (2 feet) utilizing approximately 36.2 Joules can also be applied in this example.

The trigger/transfer stage FIG. 11A is initiated when the user depresses the pedal 77. Energy is received 51 from this pedal and applied 57 to triggering a toilet flush 53, by actuating the flush linkage 74, as well as stored 52 by compressing a spring 83. The compressed spring transfers this energy by applying pressure to the plunger 72. This plunger 72 in turn applies pressure to the grey water 73 in the reservoir 71 forcing it out 87 of the exit 88 and transferring 54 it to the toilet tank. An outlet check valve 80 at the reservoir exit 88 is used to prevent the backflow of water from the toilet back into the reservoir. An inlet check valve 81 at the reservoir entrance 82 prevents grey water from leaving the reservoir inlet during this phase. The spring 83 and catch 84 mechanism work together in order to store the energy so that continued pressure is applied to the grey water by the plunger even after the user releases the pedal 77. As the grey water empties from the reservoir, the spring 83 reaches its extended position and the catch mechanism releases 85, relaxing the plunger and advancing the embodiment to the refill phase FIG. 11B.

In the refill phase, FIG. 11B, grey water enters through the inlet check valve 81 mounted in the entrance port 82 near the top of the reservoir. A vent valve 86 allows any air to rise and escape as grey water enters the reservoir. The float in this valve automatically closes as the grey water level rises filling the reservoir. In this phase, grey water is collected 50 in the reservoir over time as it becomes available from various sources, such as wash basins, filling it in preparation for the next flush cycle.

Figure 11C:
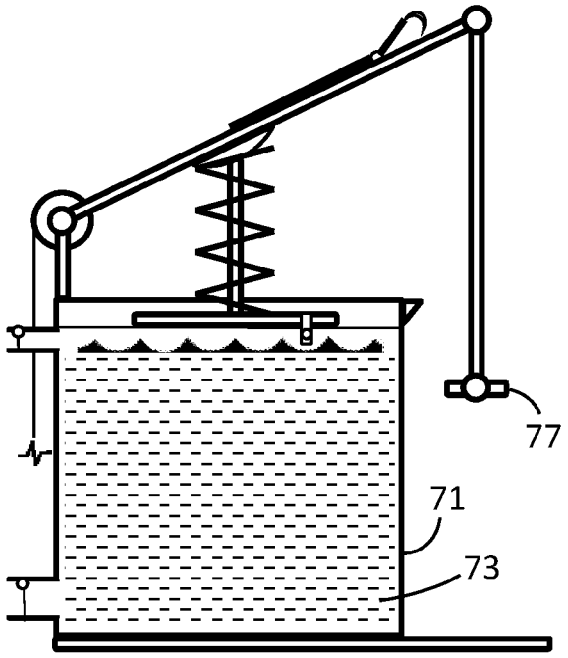

Once the reservoir is filled, the embodiment is in the ready phase FIG. 11C of operation awaiting the next toilet flush. Although the pedal 77 can be depressed at any time, during any state of fill, only the amount of grey water 73 in the reservoir 71 at the time of the pedal actuation will be transferred to toilet tank. If there is not enough grey water to refill the entire toilet tank, the toilet's native automatic fill system will continue to refill the toilet tank as it would normally. If, on the other hand, too much grey water is sent to the toilet tank, the excess amount will be automatically discharged by the toilet tank's normal overflow system.

Figure 13:
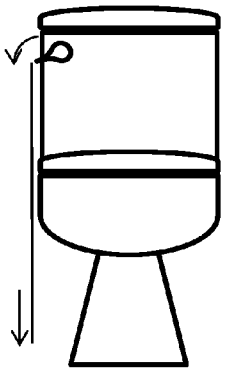
Figure 14:
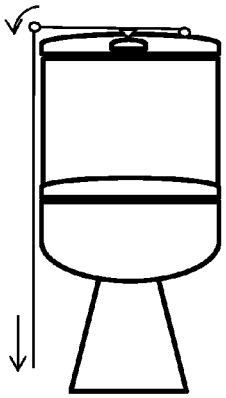
Figure 15:
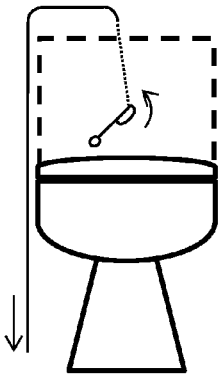

A flush trigger adapter 32 is utilized to trigger the native flush mechanism of a toilet as part of this grey water toilet system. FIG. 13, FIG. 14 and FIG. 15 are conceptualized drawings of example flush trigger adapters which can be driven by the pedal mechanism to start a flush cycle. These sample embodiments simulate a user's action of triggering a toilet flush by depressing the toilet's flush lever, see FIG. 13, or button, see FIG. 14, or actuating the toilet's flush mechanism internally, see FIG. 15. A small amount of force, substantially equivalent to what is required to manually trigger a toilet flush, is needed for the flush trigger adapter to trigger the toilet's flush mechanism. New or pre-existing adapter designs can be used as part of this grey water toilet system.

Electronic flush systems can also be remotely triggered by the foot pedal. Example designs include an electronic flush adapter connected to the internal flush electronics of the system or physically simulating the user's input (not shown).

Grey water needs to be routed into the toilet tank as part of this grey water toilet system. A custom fill adapter 76 can be utilized for this purpose. FIG. 17A through FIG. 17D show an embodiment of one such grey water fill adapter. This embodiment allows existing toilet tanks to be retrofitted so that grey water is introduced without the need for modifications to the toilet or remodeling of the room in many situations. The toilet's pre-existing functionality such as its native water fill capability and flushing capability are retained. Installation is achieved by lifting the toilet tank cover, fitting this adapter over the edge of the toilet tank and repositioning the original toilet tank cover on top of the adapter along with spacers 130 as needed. Grey water is delivered into the toilet tank with this adapter through a gap 131 between the toilet tank and its cover. A large cross sectional area 132, 133 maximizes the rate grey water can flow into the toilet tank.

This custom fill adaptor embodiment consists of a grey water entry port positioned outside of the toilet tank with a manifold body which channels the grey water to a contoured grey water exit port 134 inside the toilet tank. The manifold body 135 is designed to wrap over the upper edge of the toilet tank. This manifold body is positioned between the toilet tank and the toilet tank cover. Spacers 130 can be utilized to stabilize the toilet tank cover on top of the assembled adapter and toilet tank. Different variations of this embodiment (not shown) allow grey water to enter the toilet tank from different positions depending on the available clearance and specific layout needs within the room.

Figure 21:
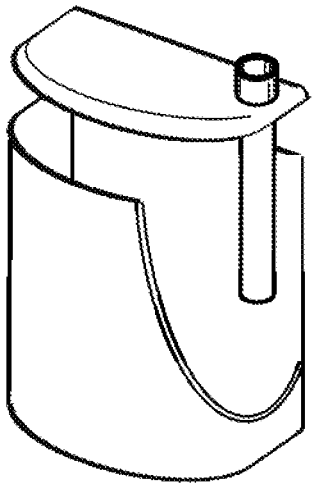
Figure 22:
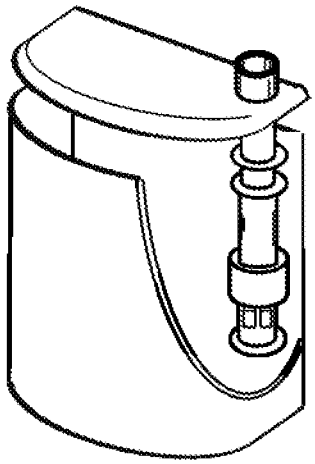
Figure 23:
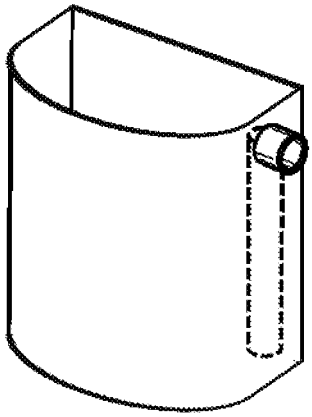
Figure 24:
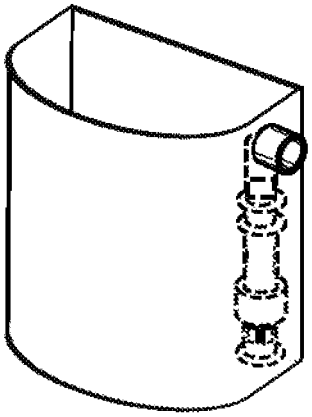

Alternatives to utilizing a custom grey water fill adapter include creating a grey water entrance hole/port directly in the toilet tank cover FIG. 21 and FIG. 22 or directly on the toilet tank, FIG. 23 and FIG. 24.

Figure 16:
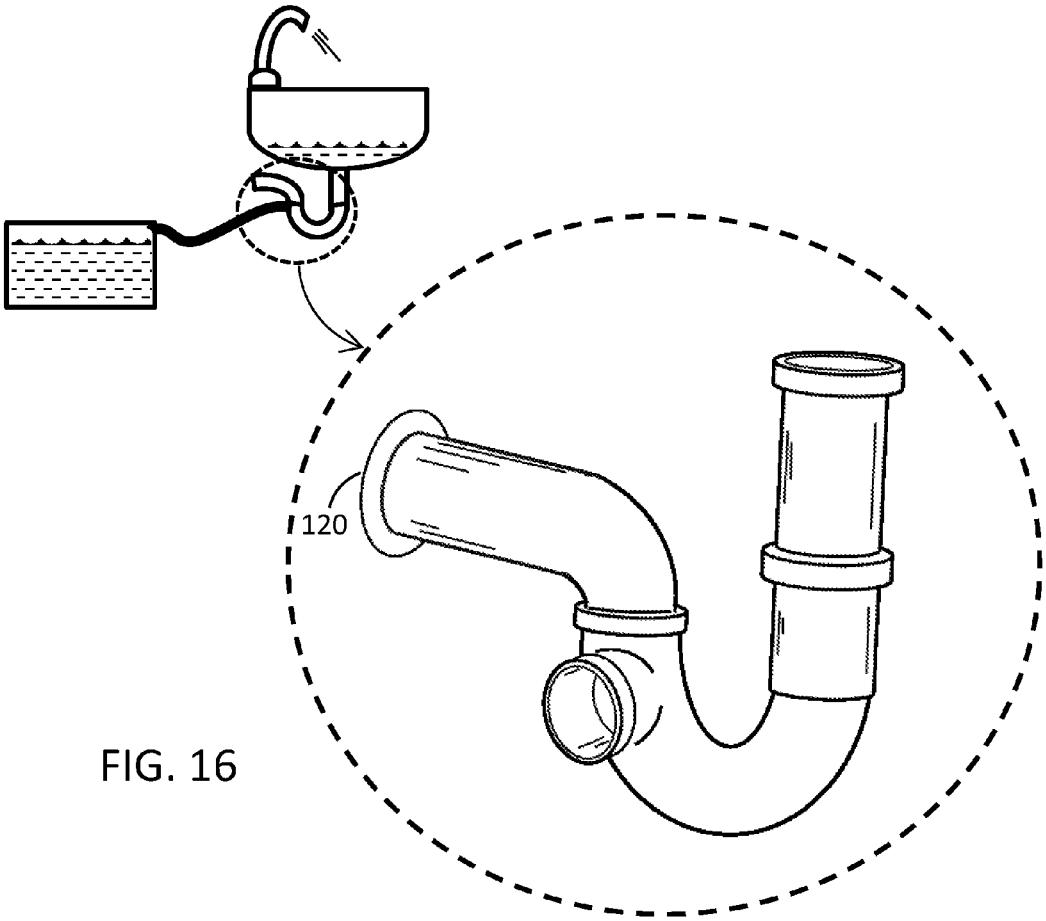
Figure 17A:
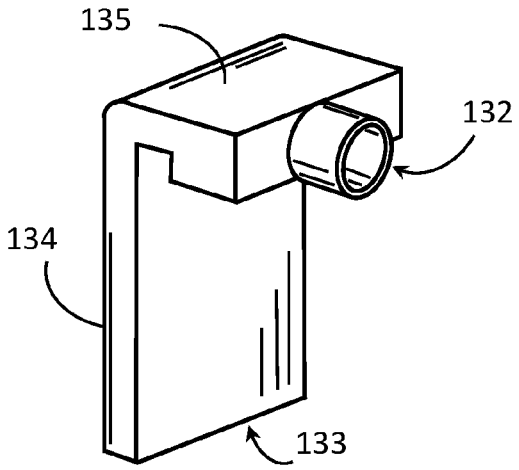
Figure 17B:
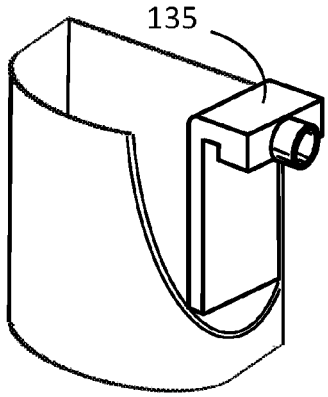
Figure 17C:
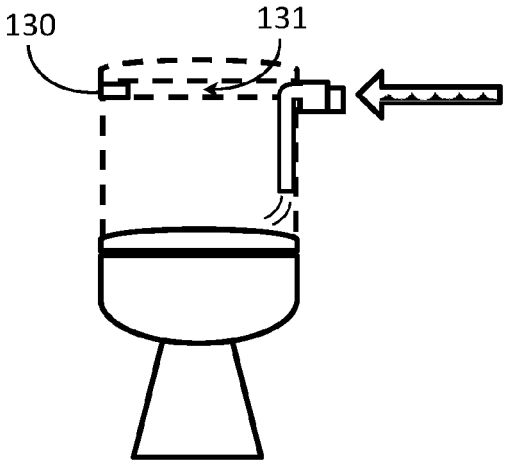
Figure 17D:
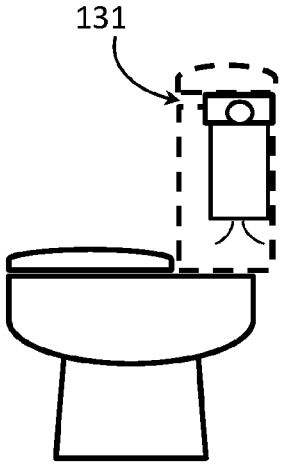
Figure 18A:
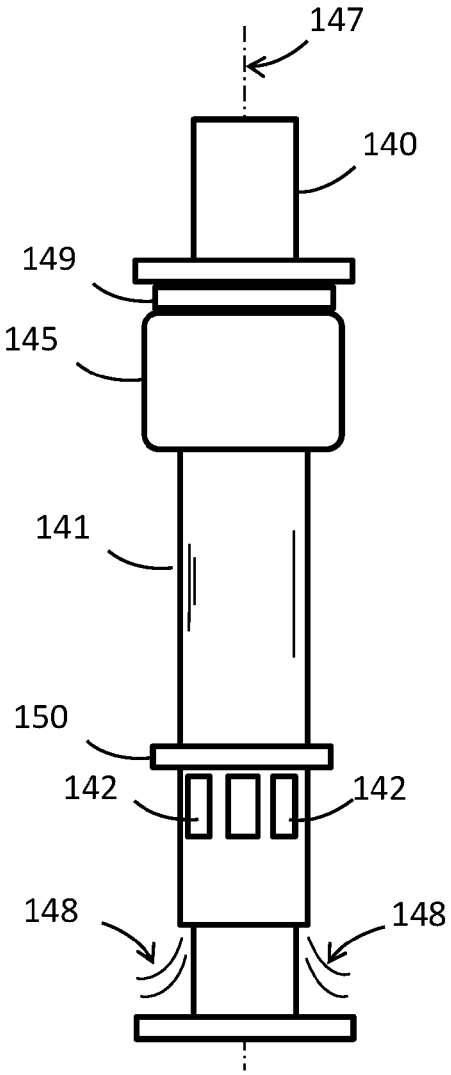
Figure 18B:
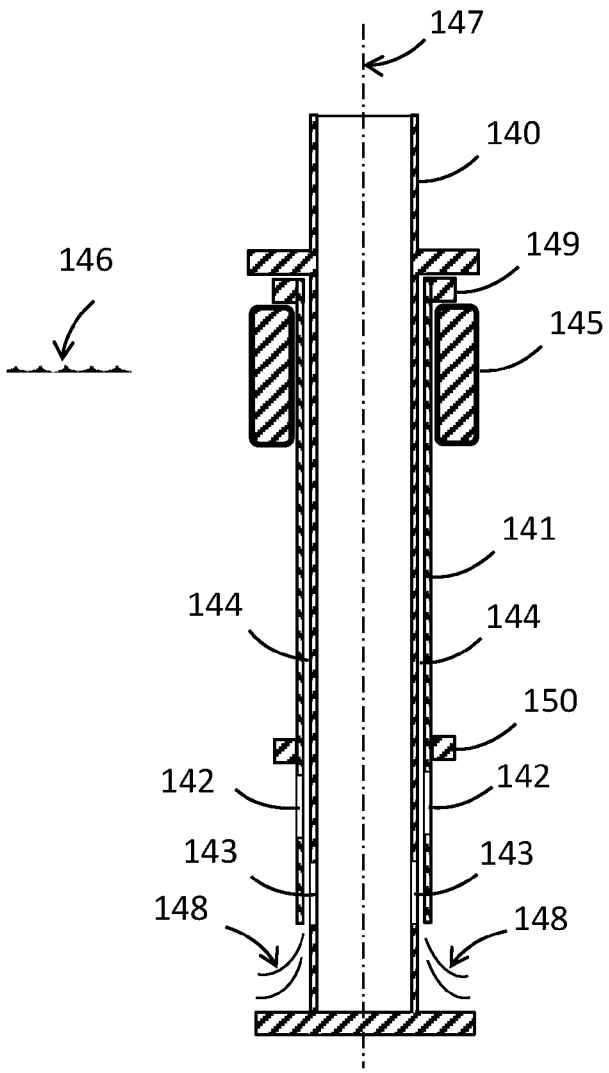
Figure 18C:
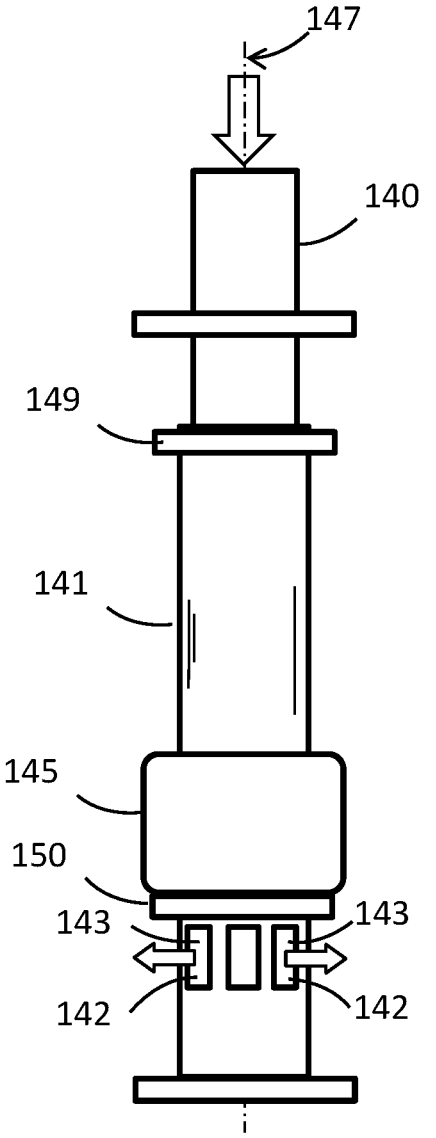
Figure 18D:
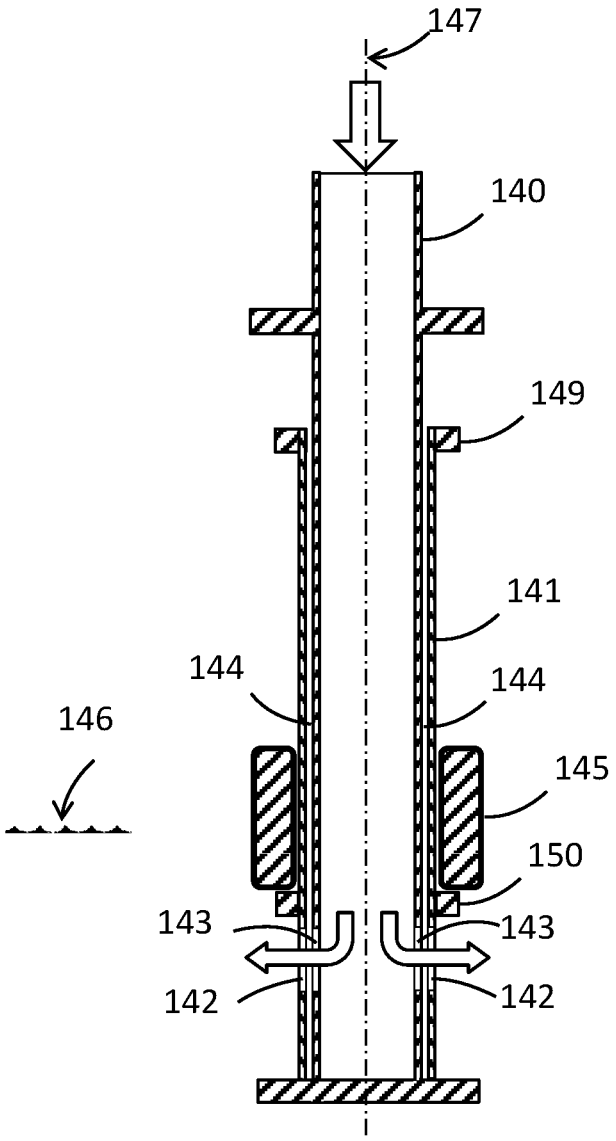
Figure 19A:
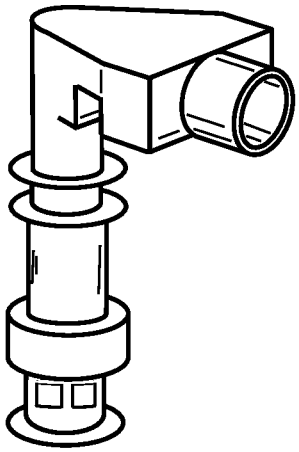
Figure 19B:
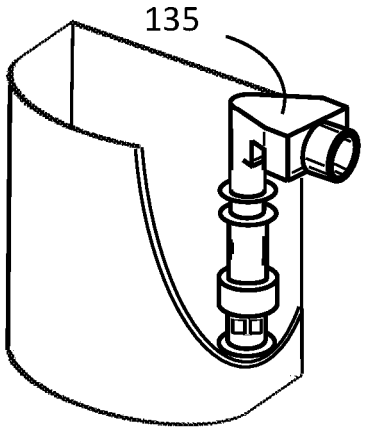
Figure 19C:
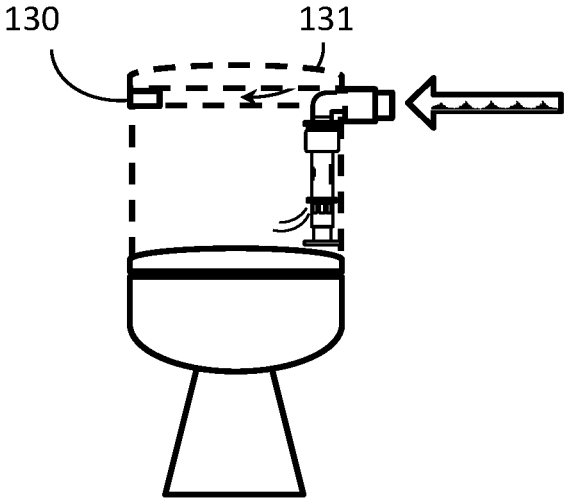
Figure 19D:
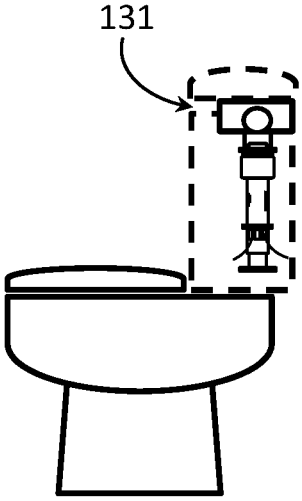

Grey water for this toilet system can come from any source. Typically, wash basins 78 can be tapped for grey water using standard drain pipe components (not shown) as well as utilizing a custom grey water extraction adapter 79, FIG. 16. In any case, the grey water extraction adapter should divert grey water from the normal drainage path to the storage reservoir. When the storage reservoir is filled to capacity with grey water, additional grey water automatically flows out through the normal drainage path 120.

An embodiment of a level sensing, high flow rate valve that can be applied to provide an explicit delay 55 to the sudden entry of fluid into the toilet tank is shown in FIG. 18A through FIG. 18D. This explicit delay device 28 is needed in some installations where the inherent system delay is insufficient for preventing the grey water from being expelled with the current flush cycle. Desirable characteristics include: an on/off state based on the surrounding liquid level; an abrupt high flow capacity, since water is sent to the valve only during a flush; a compact form factor to fit into as many toilet tanks as possible; a low actuating force to allow smaller actuating components; and a simple low maintenance design. This embodiment uses two housings 140 and 141 with exit openings 142, 143 that align FIG. 18C and FIG. 18D to allow liquid flow. A seepage gap 144 between the housings allows liquid flow which essentially removes friction between the housings, enabling free movement. A float 145 follows the liquid level in the surrounding environment 146 moving the outer housing 141, aligning the exit openings 142 and 143 to open the valve and offsetting the exit openings 142 and 143 to close the valve. The exit openings are designed and positioned so that the flow of liquid is orthogonal to and symmetric around the actuation axis 147 resulting in net force cancellation from the flow, thus substantially decreasing the required on/off state actuation force. The low actuation force requirements in this embodiment, allow for smaller float dimensions to operate this valve. However, this very low on/off state actuation force may also result in the valve opening inadvertently when the float is mid transition between the valve's off and on states. To prevent premature opening of the valve, the exit openings are positioned such as to direct the liquid seepage flow 148 to hold the outer housing 141 up, in the valve's closed position, until the float is low enough to force this outer housing 141 down, opening the valve. This seepage flow also moderates the shock effect of abrupt flow changes. Open and close levels are calibrated with the open limit adjuster 150 and close limit adjuster 149. Gasses can also flow through this seepage gap 144 providing a venting capability through the valve.

Figure 20A:
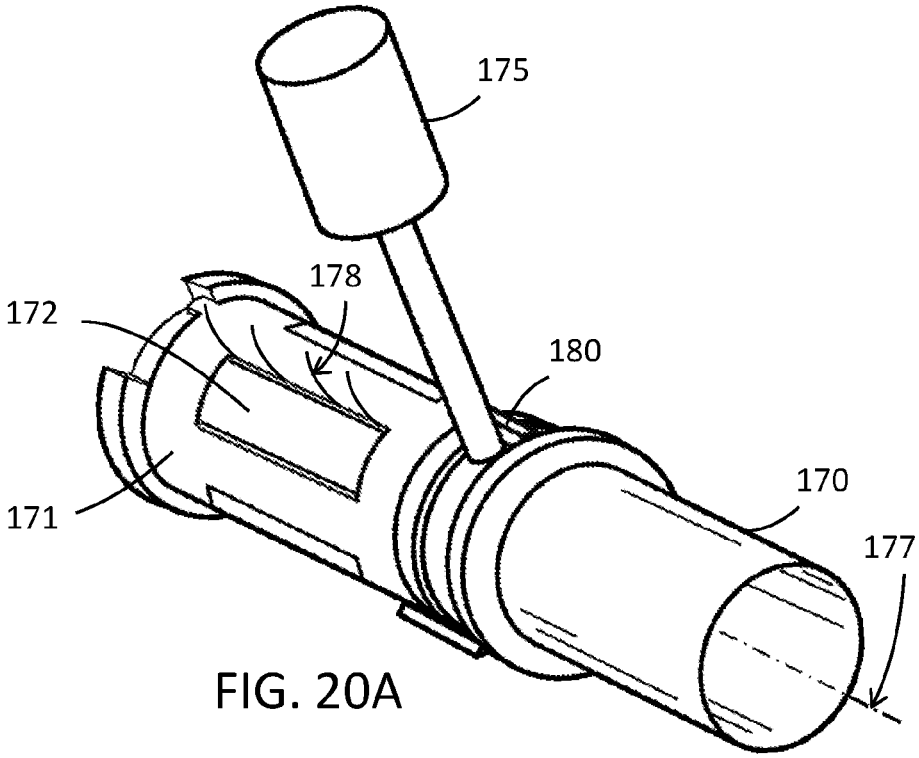
Figure 20B:
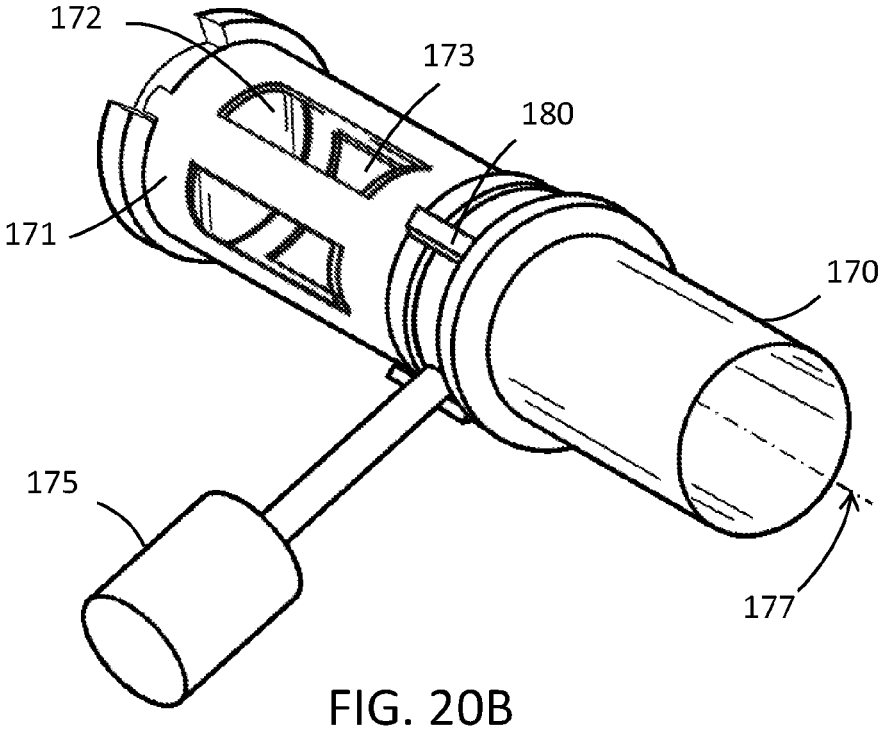
Figure 20C:
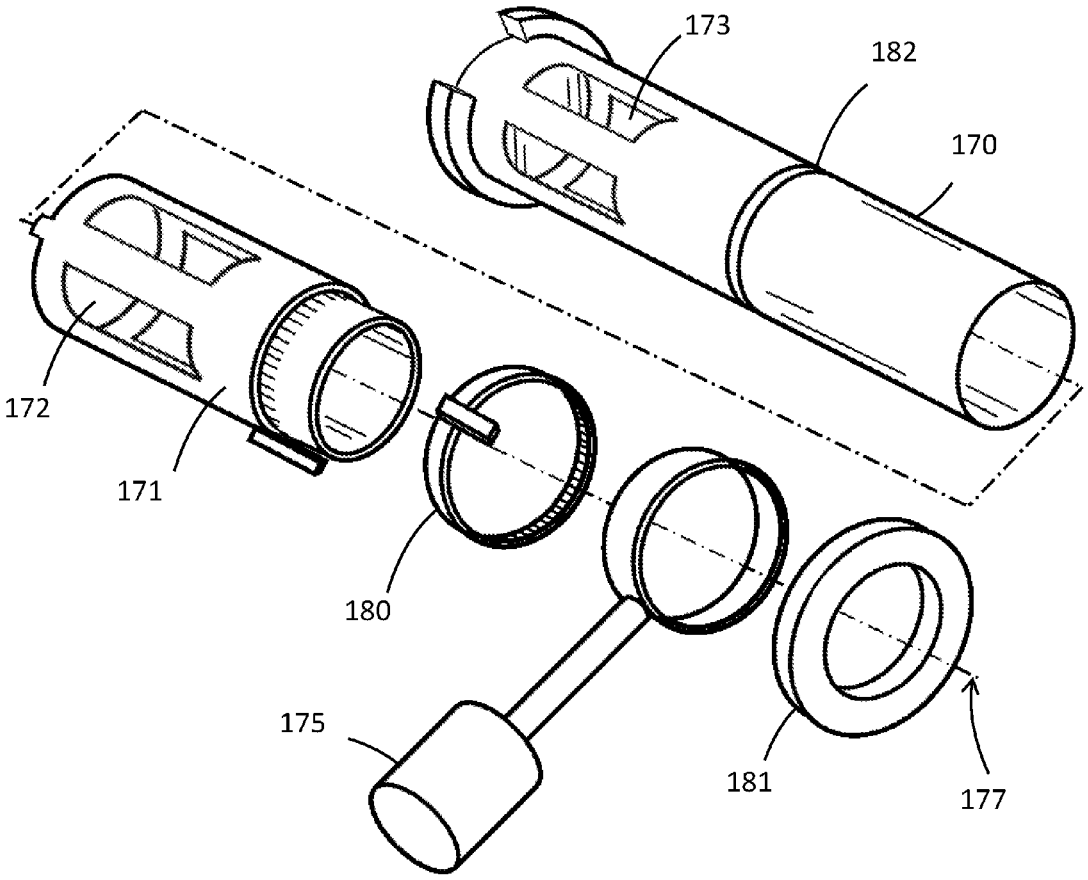

A horizontal embodiment, FIG. 20A through FIG. 20C, of a level sensing high flow rate valve is also possible and useful for certain toilet tank configurations where a vertical embodiment will not physically fit into a toilet tank. This embodiment use two housings 170 and 171 with exit openings 172, 173 that align, FIG. 20B, to allow liquid flow. A seepage gap (not shown) between the housings allows liquid flow which essentially removes friction between the housings enabling free movement. A float 175 follows the liquid level in the surrounding environment rotating the outer housing 171, aligning the exit openings 172 and 173 to open the valve and offsetting the exit openings 172 and 173 to close the valve. The exit openings are designed and positioned so that the flow of liquid is orthogonal to and symmetric around the actuation axis 177 resulting in net force cancellation from the flow, thus substantially decreasing the required on/off state actuation force. The low actuation force in this embodiment, allows for smaller float dimensions to operate this valve. However, this low on/off state actuation force may also result in the valve opening inadvertently when the float is mid transition between the valve's off and on states. To prevent premature opening of the valve, the exit openings are positioned such as to direct liquid seepage flow 178 to hold the housings in the closed position until the float is low enough rotate the outer housing 171 to open the valve. This seepage flow also moderates the shock effect with abrupt flow changes. The valve's close level is calibrated with a limit adjuster 180. The valve's open level is calibrated by rotating the entire valve assembly. Gasses can also flow through the seepage gap providing a venting capability through the valve. A locking ring 181 fits over a locking grove 182 holding the entire valve together.

Example 2: Elevation Based Grey Water Toilet Retrofit System and Method

Figure 12A:
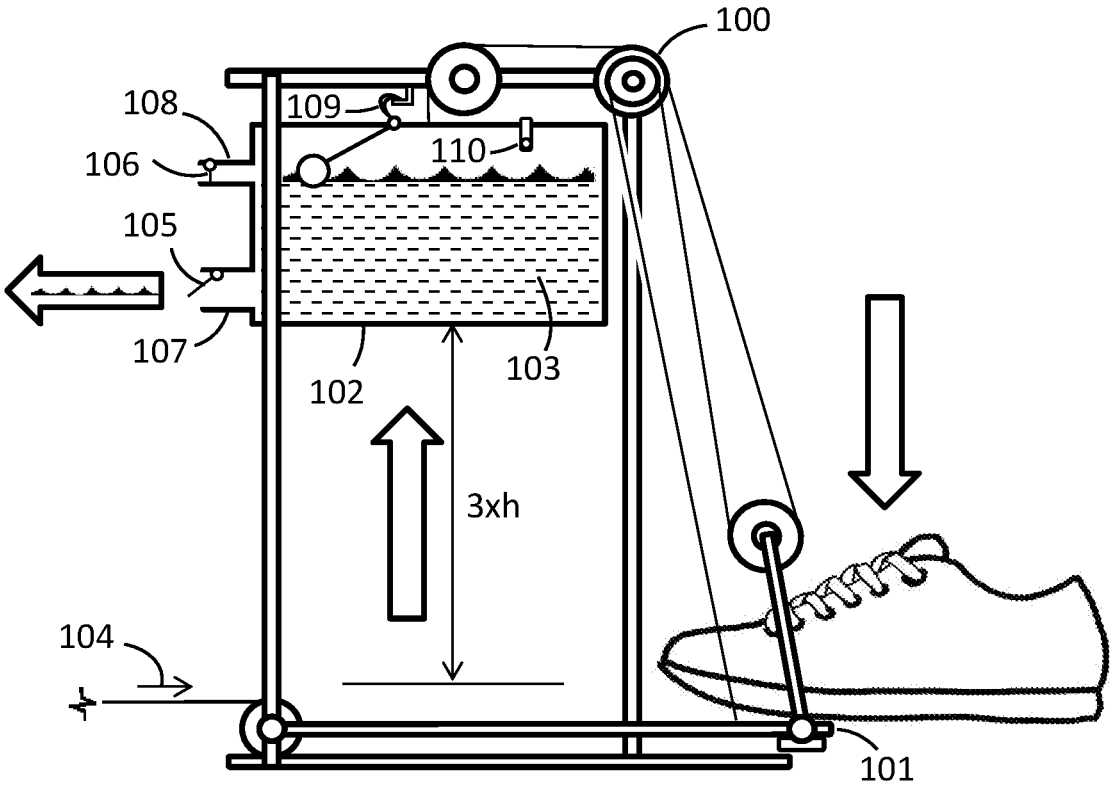
Figure 12B:
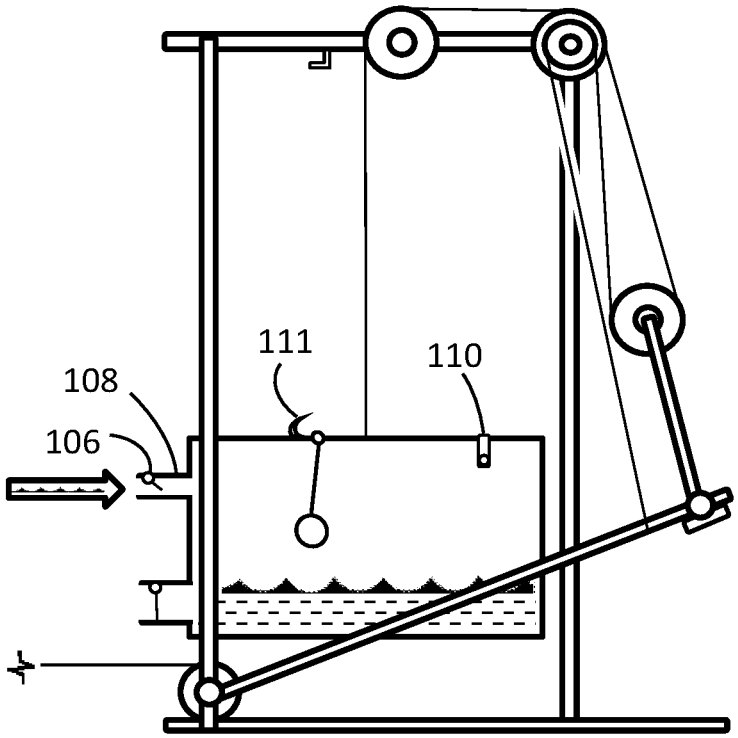
Figure 12C:
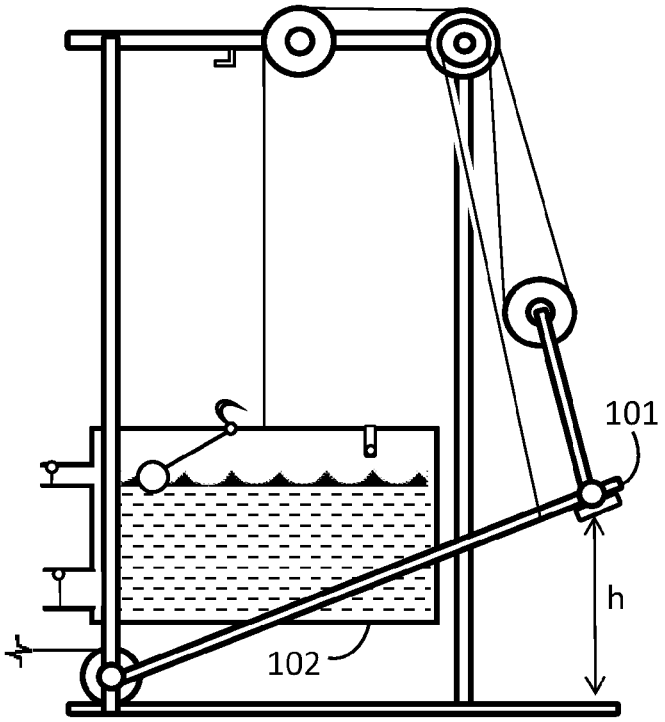

This embodiment replaces the reservoir, pedal, energy storage, flush actuator link and liquid transfer mechanisms of the first example with an elevation based mechanism. Numerous mechanisms can be utilized to raise the grey water high enough so that it will naturally flow into the toilet tank using gravity. These include displacing the grey water upward within the storage reservoir as well as physically raising the reservoir above the level of the water entrance to the toilet tank as in this embodiment. FIGS. 12A, 12B and 12C, are conceptual depictions of a mechanical embodiment which utilizes a series of pulleys 100 to multiply the pedal 101 motion in order to raise the storage reservoir 102 high enough for the grey water 103 to flow to the toilet tank. In this embodiment, the kinetic energy received from the pedal is converted to and stored as potential energy when the reservoir is raised. The number of pulleys determines the ratio of pedal movement to reservoir lift distance. In this embodiment, the pulley system multiplies the pedal movement of distance h, FIG. 12C by three times as represented by 3×h in FIG. 12A. The three phases of operation are: FIG. 12A, trigger/transfer; FIG. 12B, refill; and FIG. 12C, ready. A counter weight in the pedal offsets the weight of the empty reservoir to minimize the actuation energy required on the pedal. Flexible hoses allow the storage reservoir to move up transferring the grey water to the toilet tank.

The trigger/transfer stage FIG. 12A is initiated when the user depresses the pedal 101. Energy is received 51 from this pedal, applied 57 to triggering a toilet flush 53, by actuating the flush linkage 104, and then stored in potential form 52 by a series of pulleys 100 lifting the reservoir 102 up in elevation. The reservoir is raised high enough for the grey water to flow 54 into the toilet tank using gravity. An outlet check valve 105 at the reservoir exit 107 is used to prevent the backflow of water from the toilet back into the reservoir 102. An inlet check valve 106 at the reservoir entrance prevents grey water from leaving the reservoir inlet 108 during this phase. A vent valve 110 opens to allow air in as the grey water level drops. A catch mechanism 109 holds the reservoir in the upper position effectively storing the potential energy, so that grey water continues to flow even after the user releases the pedal 101. When the grey water becomes depleted from the reservoir, the catch mechanism releases 111, allowing the reservoir to descend and the embodiment to advance to the refill phase, FIG. 12B.

In the refill phase, FIG. 12B, grey water enters through the inlet check valve 106 mounted in the entrance port 108 near the top of the reservoir. A vent valve 110 allows any air to rise and escape as grey water enters the reservoir. The float in this vent valve automatically closes as the grey water level rises filling the reservoir. In this phase, grey water is collected 50 in the reservoir over time as it become available from various sources, such as wash basins, filling it in preparation for the next flush cycle.

Once the reservoir 102 is filled, it is in the ready phase, FIG. 12C, of operation awaiting the next toilet flush. Although the pedal 101 can be depressed at any time, during any state of fill, only the amount of grey water 103 in the reservoir 102 at the time of the pedal actuation will be transferred to toilet tank. If there is not enough grey water to refill the entire toilet tank, the toilet's native automatic fill system will continue to refill the toilet tank as it would normally. If, on the other hand, too much grey water is sent to the toilet tank, the excess amount will be automatically discharged by the toilet tank's normal overflow system.

With respect to the above descriptions then, it is to be realized that the optimum dimensional relationships for the parts of the invention, to include variations in components, size, materials, shape, form, function and manner of operation, assembly and use, are deemed to be within the expertise of those skilled in the art, and all equivalent structural variations and relationships to those illustrated in the drawings and described in the specification are intended to be encompassed by the present invention. Therefore, the foregoing is considered as illustrative only be resorted to, falling within the scope of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A method of flushing and filling toilets with grey water utilizing human energy comprising:

a. collecting grey water in a reservoir;

b. receiving human energy from a pedal;

c. triggering a first flush cycle, using up a portion of said human energy;

d. storing the remaining portion of human energy; and e. transferring said collected grey water to the toilet tank using said remaining portion of human energy, whereby completing said first flush cycle and supplying said toilet tank with said collected grey water for the next flush cycle.

2. The method of claim 1, step b wherein sufficient energy for a complete toilet flush and fill cycle is received from one actuation stroke of said pedal.

3. The method of claim 1, step b wherein the grey water toilet system operation is independent of the point in time when said pedal is released after the actuation stroke allowing the pedal to be released immediately or at any time after the actuation stroke.

4. The method of claim 1 further including an explicit delay step before introducing said grey water to said toilet tank, allowing enough time for said first flush cycle to progress to the point where said grey water is able to supply said toilet tank for said next flush cycle, preventing all of said grey water from flowing out prematurely with said first flush cycle.

5. The method of claim 4 wherein said explicit delay duration is determined by a parameter indicative of flush progress such as, for example, the liquid level in said toilet tank.

6. The method of claim 1 wherein the toilet's native mechanisms are applied comprising:

a. applying the toilet tank's native fresh water fill mechanism to supplement said grey water during the fill cycle, ensuring that sufficient liquid is available in the toilet tank for the next flush cycle;

b. applying the toilet tank's native water overflow mechanism to expel any excessive grey water introduced into said toilet tank; and c. applying the toilet tank's native flush mechanism when triggering a flush cycle.

7. A human powered grey water toilet flush and fill retrofit system comprising:

a. a reservoir for collecting grey water in advance of a toilet flush;

b. a pedal for receiving human mechanical energy from a user's foot actuation;

c. an energy storage mechanism, connected to said pedal, capable of storing said human mechanical energy, in either kinetic or potential form, to provide a continued discharge of the stored energy allowing said pedal to be released immediately after said foot actuation;

d. a flush adaptor connected to said pedal, via a flush adaptor link, used to actuate the toilet's native flush mechanism utilizing a first portion of said human mechanical energy received either directly from said pedal or indirectly from said energy storage mechanism;

e. a liquid transfer mechanism or pump connected to said energy storage mechanism and said reservoir for the transference of said grey water to a toilet tank by applying a second portion of said human mechanical energy received either directly from the pedal or indirectly through said energy storage mechanism, allowing said transference to continue after said pedal has been released; and f. a grey water outlet connecting said reservoir with said toilet tank used to route said grey water into said toilet tank.

8. The human powered grey water toilet flush and fill retrofit system of claim 7 further comprising an explicit delay mechanism for postponing the transfer of said grey water into the toilet tank, allowing enough time for said first flush cycle to progress to the point where said grey water is able to supply said toilet tank for said next flush cycle, preventing all of said grey water from flowing out prematurely with said first flush cycle.

9. The delay mechanism of claim 8 wherein the delay duration is determined by a parameter indicative of flush progress such as, for example, the liquid level in said toilet tank.

10. The grey water outlet of claim 7, part f further comprising:

a. an entrance port positioned outside of the toilet tank to receive grey water;

b. an exit port positioned inside the toilet tank to direct said grey water into the said toilet tank; and c. a manifold body connecting said entrance port with said exit port which fits between said toilet tank and the toilet tank cover, wherein the cross sectional area is the same or greater than that of the entrance port to allow a non-restrictive flow rate.

11. The grey water outlet of claim 7, part f further comprising an entrance opening through the toilet tank or toilet tank cover.

12. The human powered grey water toilet flush and fill retrofit system of claim 7 further comprising a fresh water supply reduction mechanism, allowing the toilet tank to fill with a proportionately greater volume of grey water, achievable for example by adding a delay to the existing fresh water supply mechanism or by restricting the fresh water input supply by partially closing the fresh water supply valve.

13. A liquid level sensing valve for delaying abrupt, high flow liquid entry into a toilet tank which can also be applied in other applications where seepage is allowed comprising:

a. a first housing used to convey liquid;

b. an opening on said first housing where said liquid enters;

c. one or more exit openings on said first housing where said liquid is expelled;

d. a second housing which loosely fits over said first housing, such that a seepage gap is formed between the two, allowing this second housing to slide over said first housing;

e. openings on said second housing which substantially align with said exit openings of the first housing when the valve is in the open position and substantially offsets with the exit openings of the first housing, interfering with the flow of liquid, when the valve is in the closed position; and f. a float component which moves with the level of the surrounding liquid, actuating at least one of the housings such as to substantially open and close the valve.

14. The valve of claim 13 further comprising intentional seepage flow of the conveyed liquid designed to reduce friction between the first and second housings allowing minimal actuation force.

15. The valve of claim 13 further comprising exit openings designed and positioned so that the flow of said liquid is orthogonal to and symmetric around the actuation axis resulting in net force cancellation thus substantially decreasing the required on/off state actuation force.

16. The valve of claim 13 further comprising intentional liquid seepage flow designed to hold it in its current state until said float component actuates the valve to change state to and from its open and closed positions.

17. The valve of claim 13 further comprising intentional liquid seepage flow designed to provide additional grey water to said current flush cycle enhancing flush performance.

18. The valve of claim 13 further comprising adjustable float limits to control when the valve is opened or closed based on the surrounding liquid level.

19. The valve of claim 13 further comprising intentional gaseous seepage flow to vent any trapped gasses.

* * * * *